US007246963B2

(12) United States Patent
Nishimura

(10) Patent No.: US 7,246,963 B2
(45) Date of Patent: Jul. 24, 2007

(54) IMAGE FORMING DEVICE

(75) Inventor: Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 120 days.

(21) Appl. No.: 11/002,468

(22) Filed: Dec. 3, 2004

(65) Prior Publication Data

US 2005/0141947 A1 Jun. 30, 2005

(30) Foreign Application Priority Data

Dec. 26, 2003 (JP) ..... 2003-435931

(51) Int. Cl.
*B41J 29/02* (2006.01)
*B41J 29/13* (2006.01)

(52) U.S. Cl. ..... 400/692; 400/691; 400/693; 347/108

(58) Field of Classification Search ..... 399/110, 399/111, 113, 114, 125, 405, 34; 271/273; 400/692, 691; 347/245, 108
See application file for complete search history.

(56) References Cited

U.S. PATENT DOCUMENTS 5,238,317 A * 8/1993 Bohmer et al. ..... 400/693
5,276,480 A * 1/1994 Takahashi ..... 399/125
5,438,391 A * 8/1995 Maekawa et al. ..... 399/125
5,587,769 A * 12/1996 Sawada et al. ..... 399/113
6,011,935 A * 1/2000 Matsuzaka et al. ..... 399/12
6,487,376 B1 * 11/2002 Wang et al. ..... 399/12
6,735,406 B1 * 5/2004 Noda ..... 399/111
6,980,758 B2 * 12/2005 Murayama et al. ..... 399/111
7,016,629 B2 * 3/2006 Ishii et al. ..... 399/258
2005/0206709 A1 * 9/2005 Iwata et al. ..... 347/104

FOREIGN PATENT DOCUMENTS

JP A-03-048259 3/1991
JP 05238107 A * 9/1993
JP 06110262 A * 4/1994
JP Y2-07-022677 5/1995
JP 11198483 A * 7/1999
JP 2000181168 A * 6/2000
JP 2000335045 A * 12/2000
JP A-2002-111243 4/2002
JP 2002274693 A * 9/2002
JP A-2002-351282 12/2002
JP 2005134661 A * 5/2005

* cited by examiner

*Primary Examiner*—Ren Yan
*Assistant Examiner*—Matthew Marini
(74) *Attorney, Agent, or Firm*—Oliff & Berridge, PLC

(57) ABSTRACT

A laser beam printer includes a casing with a discharge tray disposed on the top surface of the casing. A cutout part is formed in the top surface of the casing and an opening is formed in the front surface of the casing for facilitating mounting and removal of a process cartridge. The opening can be closed with a cover. When the cover is in a closed position, a top cover part of the cover blocks the cutout part. At this time, the top cover part and a main discharge tray part of the discharge tray are adjacent to one another and function to support paper. When the cover is in an open position, the cutout part is exposed; the top cover part is separated from the main discharge tray part; and the paper is supported by the main discharge tray alone.

21 Claims, 14 Drawing Sheets

IMAGE FORMING DEVICE

BACKGROUND OF THE INVENTION

1. Field of the Invention

The present invention relates to an image forming device.

2. Related Art

Image-forming devices well known in the art include a front access type printer. This type of printer has a casing formed with an opening in its front surface, and a cover capable of swinging open and closed on the casing to expose or cover the opening. Hence, process cartridges and other detachable parts can be installed to or removed from the casing through the opening by opening this cover. Because of its user-friendliness, this construction has been made employed in various practical devices, such as that disclosed in Japanese unexamined patent application publication No. 2002-111243.

To meet today's demands, however, devices must not only be user-friendly, but also thin and compact. In order to satisfy these needs, restrictions have been placed on the layout of these devices. Accordingly, when conventional configurations are used, a grip formed on the process cartridge or other detachable part is difficult to grip during replacement operations, and levers or other operating parts located inside the printer are difficult to operate. If the device is configured to be lower in height, for example, either the height of the opening formed in the front surface of the device must be decreased or the position of the entire opening must be lowered, making access from the front more difficult.

SUMMARY OF THE INVENTION

To overcome these problems, it is conceivable to configure the image-forming device with a cover that spans not only the front surface of a casing, but also a paper supporting section provided on the top surface of the casing. When the cover is opened, both the front surface of the casing and a forward region of the paper supporting section open simultaneously, exposing a grip of a process cartridge disposed in an upper front region of the casing. However, while a wide opening can be formed in the device with this construction, facilitating access to the process cartridge, the surface area of the paper supporting section for supporting recording sheets is reduced, and sheet support is unstable.

In view of foregoing, it is an object of the present invention to overcome the above problems, and also to provide an image-forming device having a casing formed with an opening, through which detachable parts may be inserted or removed, in its front and top surfaces, facilitating access to the inside of the casing, but top surface portions of the casing can support recording sheets with stability.

In order to attain the above and other objects, according to one aspect of the present invention, there is provided an image-forming device including a casing and a cover. The casing has a vertical wall and a top wall. The vertical wall is formed with an opening through which a detachable member is inserted into and removed from the casing. The top wall is formed with a cutout part that is continuous with the opening. The cover includes a first part that covers the opening and a second part that covers the cutout part. The cover is movable between an open state and a closed state. When the cover is in the closed state, the second part of the cover and a portion of the top wall of the casing are adjacent to one another in a first direction. When the cover is in the open state, the second part of the cover and the portion of the top wall are separated from each other and a recording medium discharged from the casing is supported by a part of the top wall.

According to another aspect of the present invention, there is provided an image-forming device including a casing, a first cover, and a second cover. The casing has a vertical wall and a top wall. The vertical wall is formed with a first opening, and the top wall is formed with a second opening continuous with the first opening. The first cover is capable of opening and closing to selectively expose and cover the first opening. The second cover is supported on the casing and pivots open and closed about an axis to selectively expose and cover the second opening. A medium discharged from the casing is supported on the top wall and the second cover.

BRIEF DESCRIPTION OF THE DRAWINGS

In the drawings:

FIG. 16(*b*) is a plan view showing the main parts of the laser beam printer of FIG. 15 wherein the front cover is open.

PREFERRED EMBODIMENTS OF THE PRESENT INVENTION

Next, a first embodiment of the present invention will be described with reference to FIGS. 1 to 7 in which the image-forming device according to the present invention is applied to a laser beam printer.

Figure 1:
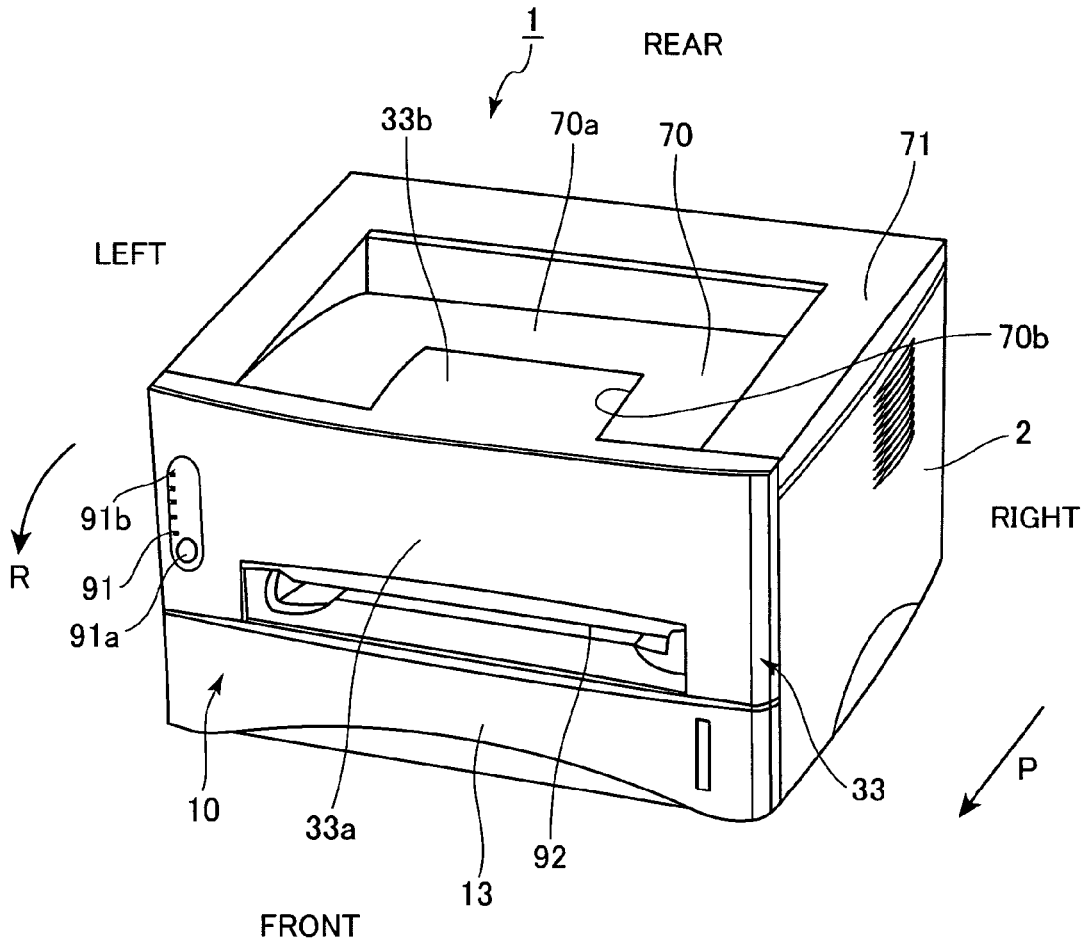
FIG. 1 is a perspective view of a laser beam printer according to a first embodiment of the present invention.

As shown in FIG. 1, a laser beam printer 1 according to the first embodiment includes a main casing 2 having a substantially rectangular parallelepiped shape. A sheet supply cassette 10 for supporting a stack of recording sheets S (FIG. 6) is disposed in the lower section of the main casing 2. The sheet supply cassette 10 is formed with a grip 13 and can be detached from the main casing 2 by being pulled toward the front as indicated by an arrow P.

Figure 2:
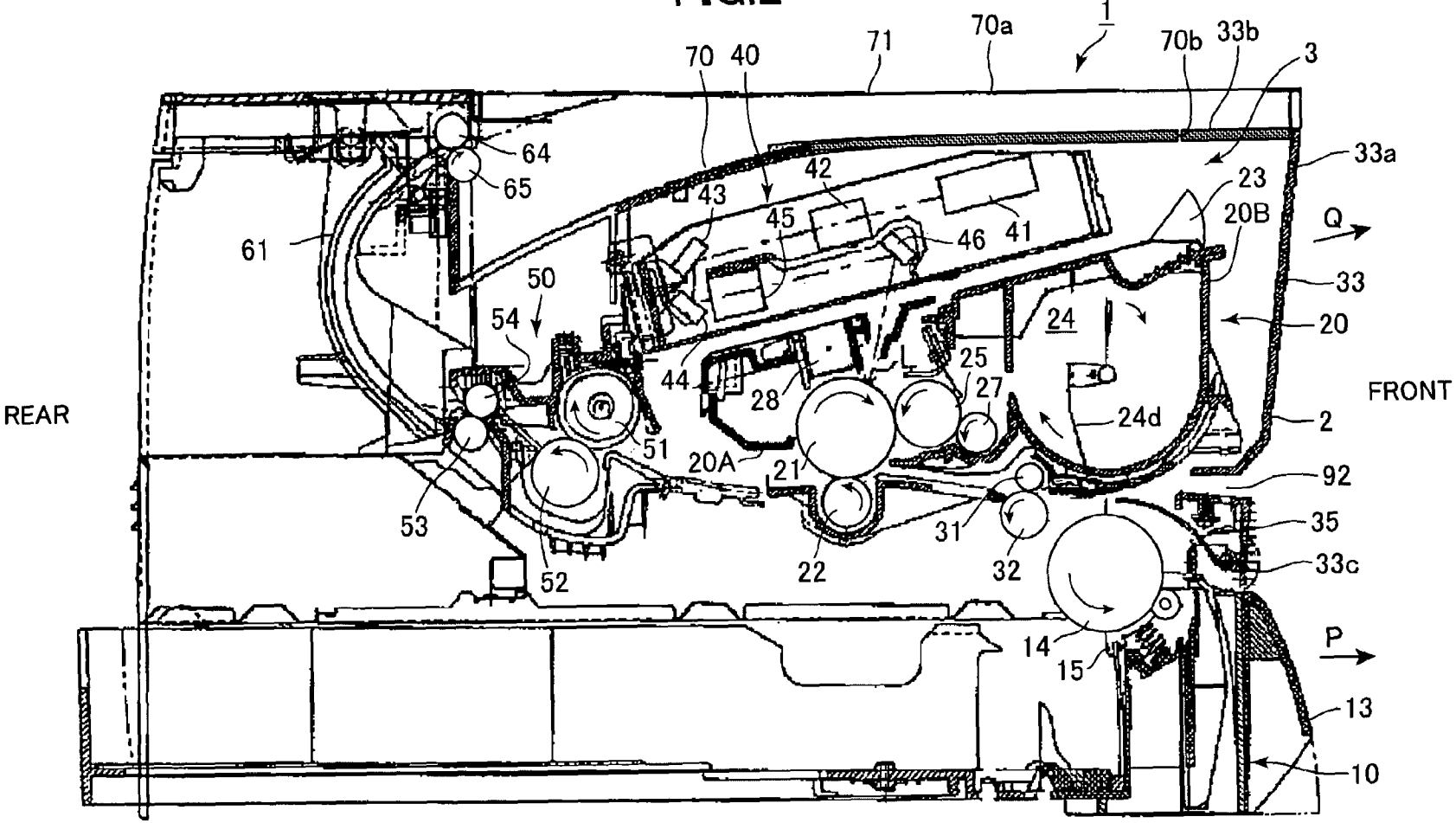
FIG. 2 is a cross-sectional side view of the laser beam printer of FIG. 1.

Although not shown in the drawings, the sheet supply cassette 10 includes a pressing plate for mounting a stack of recording sheets S and a spring for urging the pressing plate upward. As shown in FIG. 2, a sheet supply roller 14 is disposed inside the main casing 2 so as to be rotatable in a direction indicated by an arrow. An uppermost sheet S of the stack on the pressing plate is pressed against the sheet supply roller 14 by the urging force of the spring, and is separated from the stack and fed by the rotation of the sheet supply roller 14 in cooperation with a separating pad 15. A guide 35 is provided for reversing the direction of recording sheets S fed from the sheet supply cassette 10.

As shown in FIG. 2, an image forming section 3 is disposed in the main casing 2. The image forming section 3 includes a process cartridge 20, a laser scanner 40, and a fixing unit 50.

The process cartridge 20 is disposed above the sheet supply cassette 10 so as to be freely inserted to and detached from the main casing 2. When performing maintenance operations, such as when replenishing with toner, the process cartridge 20 is pulled out in a direction indicated by an arrow Q. The process cartridge 20 includes a photosensitive cartridge 20A and a developing cartridge 20B.

The photosensitive cartridge 20A includes a photosensitive drum 21 for bearing toner images, a transfer roller 22 for transferring toner images from the photosensitive drum 21 onto a recording sheet S, and a scorotron charger 28 for generating a corona discharge so as to positively charge the surface of the photosensitive drum 21. The developing cartridge 20B includes a developing chamber 24 for housing toner, a developing roller 25 for supplying toner to the photosensitive drum 21, and a supply roller 27 for supplying toner to the developing roller 25. An agitator 24*a* for agitating toner is disposed in the developing chamber 24.

Although the photosensitive cartridge 20A and the developing cartridge 20B can be separated from each other, the entire process cartridge 20 is removed from the main casing 2 as an integrated unit.

Figure 5:
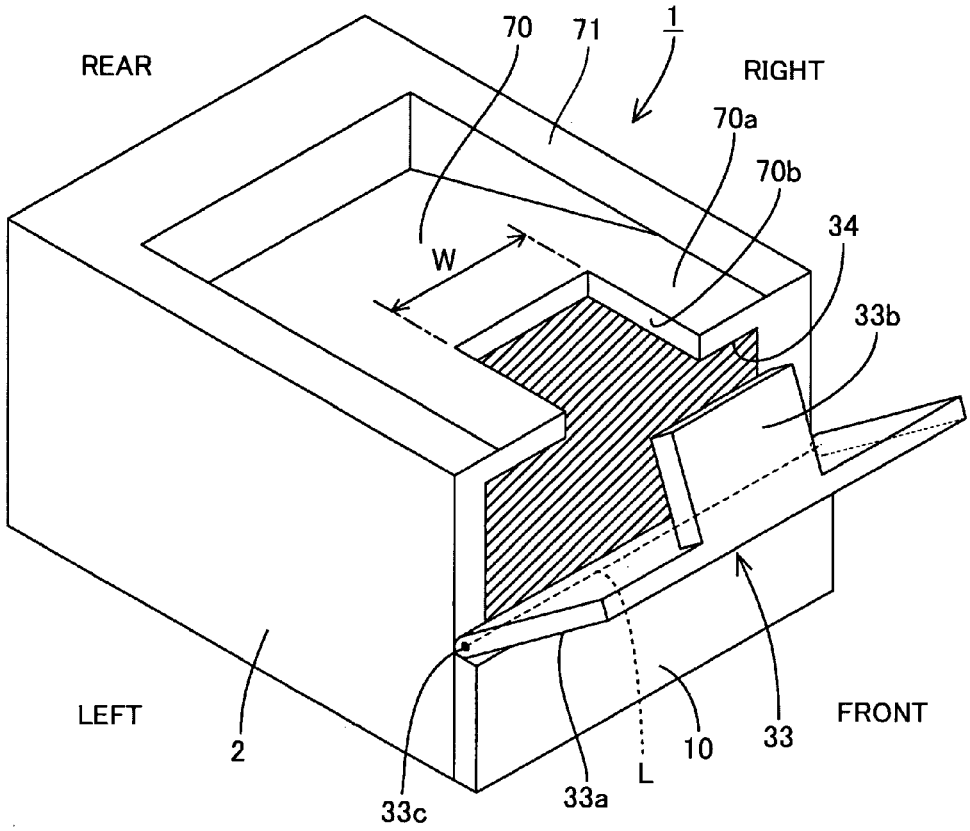
FIG. 5 is a schematic diagram of the laser beam printer of FIG. 1.

As shown in FIG. 5, an opening 34 is formed in the front surface of the main casing 2 through which the process cartridge 20 is mounted and removed. A cutout part 70*b* is formed continuously with the opening 34 in the top surface of the main casing 2. A cover 33 is provided to the front surface of the main casing 2. The cover 33 is capable of pivoting about a pivotal shaft 33*c* at its lower end for covering or exposing the opening 34 and the cutout part 70*b*. A dotted line L in FIG. 5 indicates the axis of the pivotal shaft 33*c*. By pivoting the cover 33 in a direction R (FIG. 1) to expose the opening 34 and the cutout part 70*b*, the process cartridge 20 can be mounted in or removed from the main casing 2.

As shown in FIG. 1, provided on the front surface of the cover 33 are an operating unit 91 having a control button 91*a* and an LED 91*b*, and an insertion slot 92 for inserting hand-fed sheet.

As shown in FIG. 2, a pair of registration rollers 31, 32 is rotatably disposed between the process cartridge 20 and the sheet supply cassette 10.

The laser scanner unit 40 is disposed above the process cartridge 20 and includes a laser generation unit (not shown) for generating a laser beam, a polygon mirror (hexahedral mirror) 41, lenses 42, 45, and reflection mirrors 43, 44, 46. As shown in FIG. 2, a laser beam L redirected by the polygon mirror 41 is irradiated onto the photosensitive drum 21 after passing through or being reflected off of the lens 42, the reflecting mirrors 43 and 44, the lens 45, and the reflecting mirror 46 to form an electrostatic latent image on the surface of the photosensitive drum 21.

The fixing unit 50 is for fixing toner onto a recording sheet S and is disposed to the rear of the process cartridge 20. The fixing unit 50 includes a heat roller 51 for generating heat, a pressing roller 52 disposed in opposition to the heat roller 51, and a pair of discharge rollers 53, 54.

A chute 61 formed in a curved shape is pivotably disposed on the rear side of the conveying rollers 53 and 54 for reversing the direction of a recording sheet S when necessary. A discharge tray 70 is provided on the top surface of the main casing 2. A pair of discharge rollers 64 and 65 are disposed along a line continuing from the top end of the chute 61 for discharging a recording sheet S conveyed along the chute 61 onto the discharge tray 70.

When the chute 61 is pivoted toward the rear, a recording sheet S is discharged onto the chute 61, but not on the discharge tray 70. By pivoting the chute 61 toward the rear, the recording sheet S is conveyed and discharged in a straight line, which is particularly useful when printing on a hand-fed thick sheet or the like.

Figure 4:
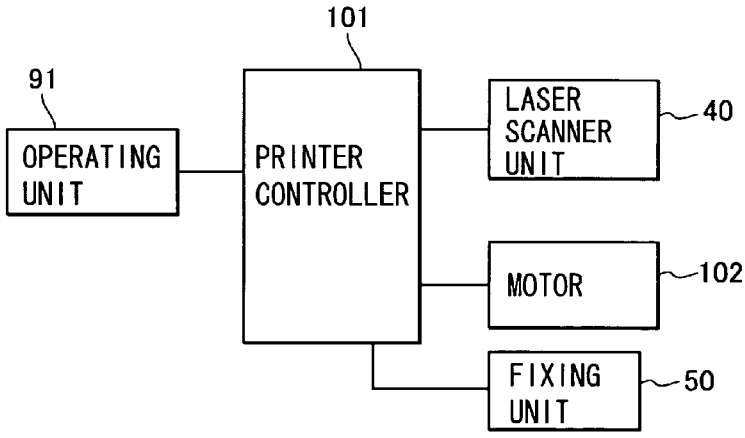
FIG. 4 is a block diagram of a control system of the laser beam printer of FIG. 1.

FIG. 4 shows a control system of the laser beam printer 1. The control system includes a printer controller 101 and a motor 102 connected to the printer controller 101. The printer controller 101 performs overall control of the laser beam printer 1. The motor 102 is a driving source of the operating unit 91, the laser scanner unit 40, the fixing unit 50, and other driving mechanisms.

Next, image forming operations in the laser beam printer 1 will be described. When the sheet feed roller 14 shown in FIG. 2 is rotated at a predetermined timing, recording sheets S are fed one at a time from the sheet supply cassette 10. After the guide 35 reverses the recording sheet S, the registration rollers 31 and 32 adjust the position of the leading edge of the recording sheet S and subsequently convey the recording sheet S between the photosensitive drum 21 and the transfer roller 22.

In the meantime, laser light emitted from the laser scanning unit 40 is irradiated onto the surface of the photosensitive drum 21, which has been charged by the charger 28, forming an electrostatic latent image on the surface. When the electrostatic latent image formed on the photosensitive drum 21 confronts the developing roller 25, toner conveyed via the supply roller 27 and the developing roller 25 develops this latent image into a toner image. The toner image is transferred onto the recording sheet S as the recording sheet S passes between the photosensitive drum 21 and the transfer roller 22.

The recording sheet S with the toner image transferred thereon is fed between the heat roller 51 and the pressure roller 52. At this time, pressure and heat is applied to the toner image on the recording sheet S, thereby fixing the toner image onto the recording sheet S.

Passing between the conveying rollers 53 and 54, the recording sheet S is conveyed along the chute 61 to the discharge rollers 64 and 65. The discharge rollers 64 and 65 discharge the recording sheet S onto the discharge tray 70 with the printed surface face down.

Next, the cover 33 will be described in detail. As shown in FIGS. 1 and 5, the cover 33 includes a front cover part 33*a* for covering the front side of the main casing 2 and an upper cover part 33*b* for covering the upper side of the main casing 2. The upper cover part 33*b* is integrally formed with the front cover part 33*a*.

When in its closed position shown in FIG. 1, the cover 33 covers the top surface of the main casing 2 so that the cutout part 70*b* is blocked. When the cover 33 is in its open position, the cutout part 70*b* is open. The top end of the front cover part 33*a* is the free end, and the front cover part 33*a* can pivot about the pivotal shaft 33*c* extending in the left-to-right direction at its bottom end.

As shown in FIG. 5, a protruding part 71 formed with a flat top surface is provided around (on the left, right, and rear sides of) the discharge tray 70, so that the discharge tray 70 is sunken below the top surface of the protruding part 71. The discharge tray 70 includes a main discharge tray 70*a* in which the cutout part 70*b* is formed and the top cover part 33*b*. The cutout part 70*b* is formed in the widthwise center region of the discharge tray 70.

Figure 6:
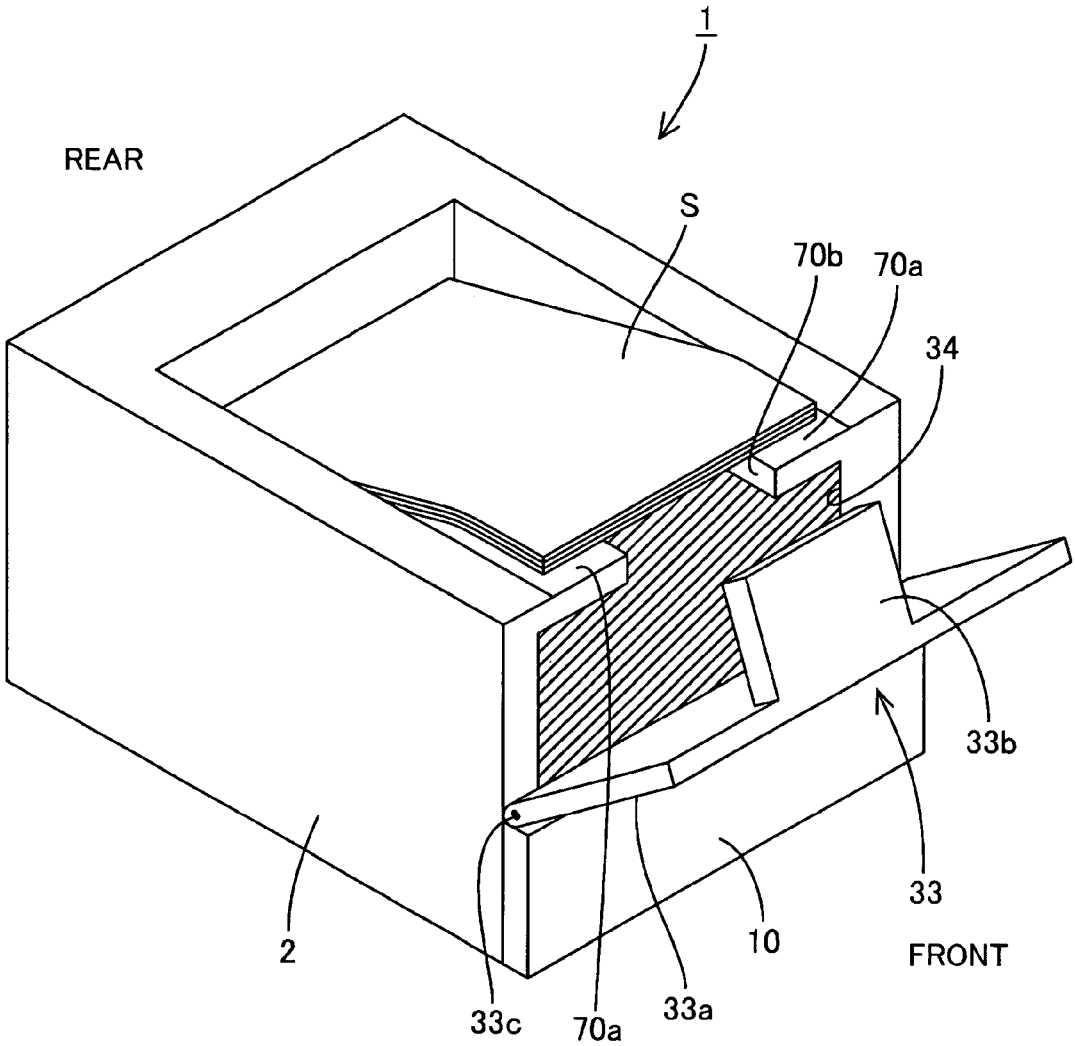
FIG. 6 is a schematic diagram of the laser beam printer of FIG. 1 with paper sheets mounted on a discharge tray.

When the cutout part 70*b* is closed as shown in FIG. 1, at least a portion of the side surfaces of the top cover part 33*b* and a portion of the side surfaces of the main discharge tray 70*a* are adjacent to one another in the left-to-right direction, and recording sheets S can be supported by at least a portion of the main discharge tray 70*a*. On the other hand, when the cutout part 70*b* is open as shown in FIG. 5, the side surfaces of the top cover part 33*b* are separated from the side surfaces of the main discharge tray 70*a*, and recording sheets S are supported by a portion of the main discharge tray 70*a* as shown in FIG. 6. Here, the discharge tray 70 may be configured so that only the main discharge tray 70*a* supports recording sheets S when the cutout part 70*b* is closed, or that both the main discharge tray 70*a* and the top cover part 33*b* support the recording sheets S. The recording sheets S can be supported with greater stability when both the main discharge tray 70*a* and the top cover part 33*b* are configured to support the recording sheets S. Thus, recording sheets S discharged onto the discharge tray 70 can be reliably supported by the main discharge tray 70*a* even when the cutout part 70*b* is open.

According to the present embodiment, by providing the opening 34 in the front surface of the main casing 2 and the cutout part 70*b* in the top surface of the main casing 2, an operator can easily gain access to the inside of the main casing 2 when mounting or removing the process cartridge 20.

Figure 3:
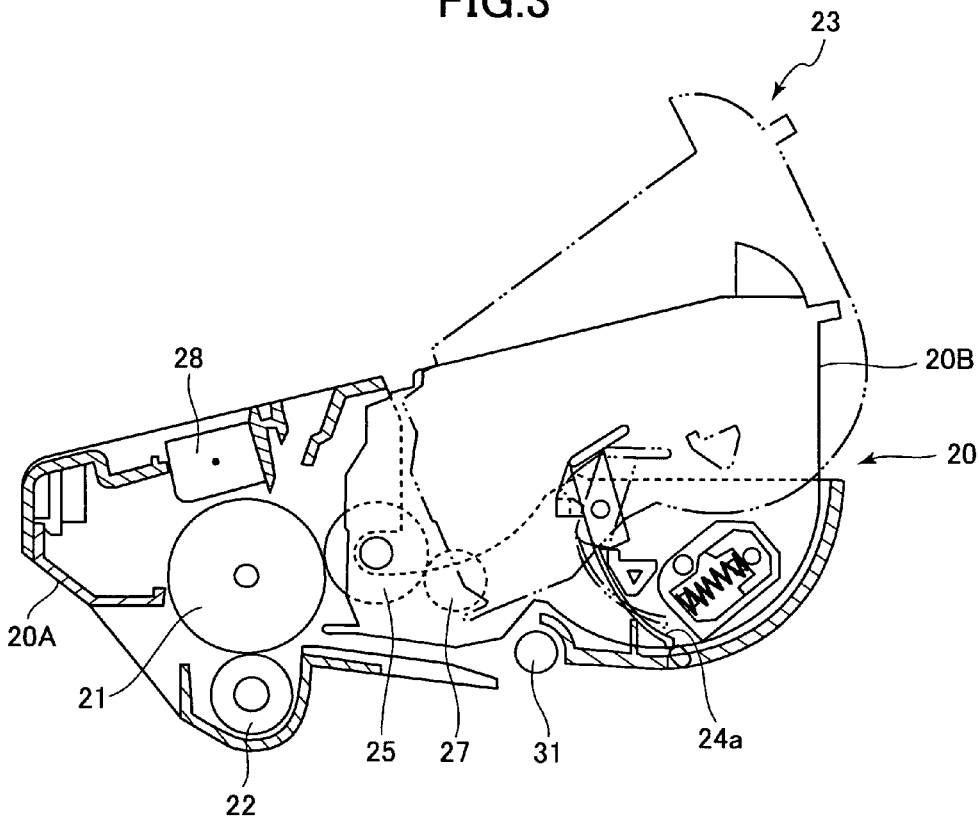
FIG. 3 is a cross-sectional view of a process cartridge according to the first embodiment of the present invention.

Also, as shown in FIG. 2, a grip 23 is formed on the front end of the process cartridge 20 so that the grip 23 is located at a position below the cutout part 70*b* and visible through the cutout part 70*b* when viewed from above. Therefore, the process cartridge 20 can be easily accessed from above since the grip 23 is positioned below the cutout part 70*b*. Note that the grip 23 shown in FIG. 3 is merely an example, and a different gripping construction that allows an operator to grip the process cartridge 20 may be used.

In the present embodiment, a width W (FIG. 5) of the cutout part 70*b* is preferably 10 to 20 cm. This width is large enough for an operator to pass a hand through the cutout part 70*b*, while preventing the commonly used A4-size sheet S from falling through the cutout part 70*b* when the cutout part 70*b* is open.

Figure 7:
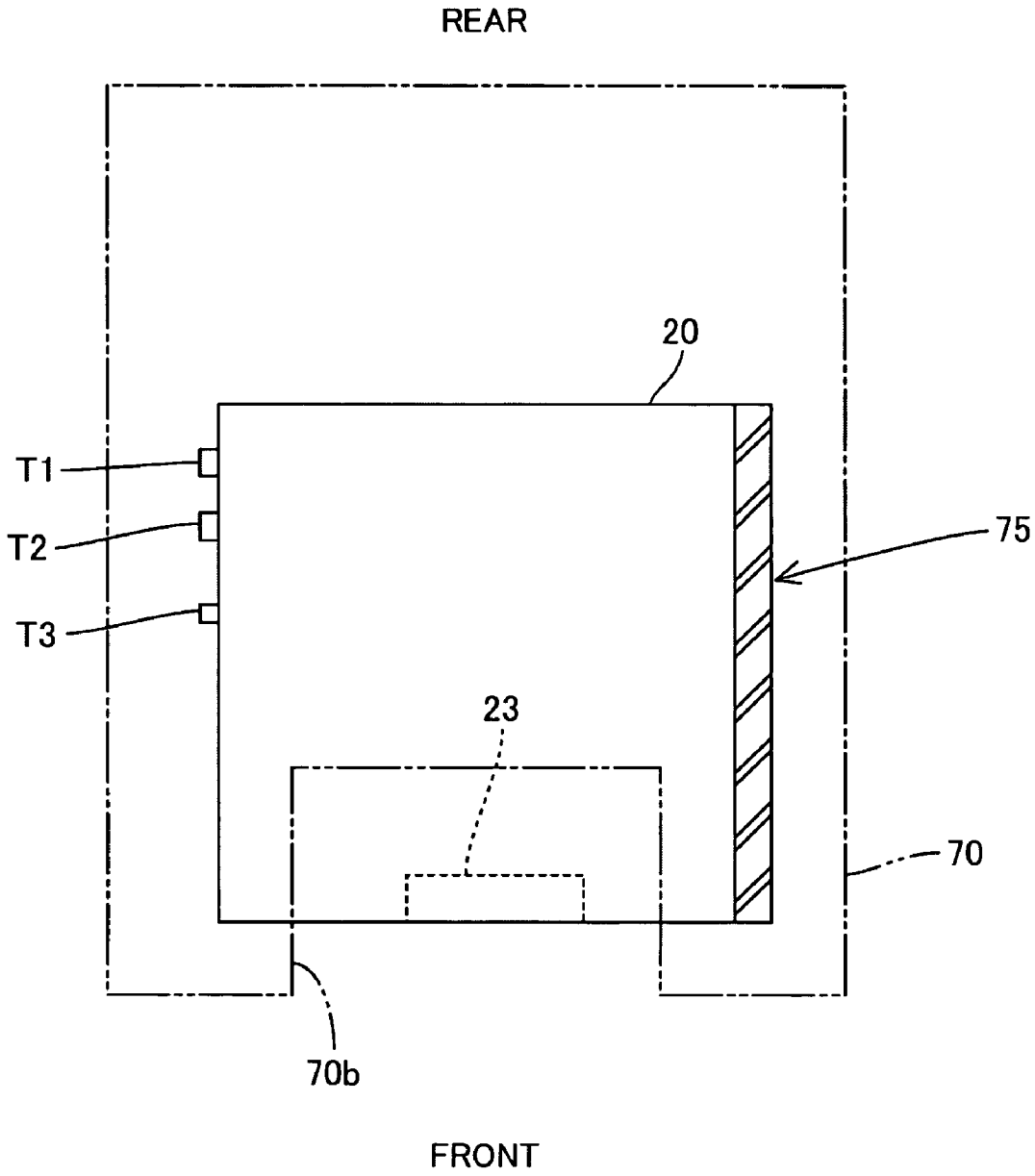
FIG. 7 is an explanatory view showing paper sheets being mounted on the discharge tray of the laser beam printer of FIG. 1.

As shown in FIG. 7, electrodes T1 to T3 are provided on one side of the process cartridge 20, while a drive unit 75 is provided on the other side. Portions of the main discharge tray 70*a* on both widthwise sides of the cutout part 70*b* cover the electrodes T1 to T3 and the drive unit 75.

The electrodes T1 to T3 are for transmitting driving power to the charger 28, the developing roller 25, the transfer roller 22, and the like. The driving portion 75 is for driving the photosensitive drum 21, the developing roller 25, and the supply roller 27, and includes a gear train, for example, disposed at the sides of the photosensitive drum 21, the transfer roller 22, and the like. Being covered by the main discharge tray 70*a* in this way, the electrodes T1 to T3 and the drive unit 75 are effectively protected from such external factors as dust.

Note that FIG. 7 shows conceptually the amount of space occupied by the drive unit 75. Also, while the electrodes T1 to T3 and the drive unit 75 are disposed on both sides of the process cartridge 20 in the present embodiment, both the electrodes T1 to T3 and the drive unit 75 may be disposed on one side of the process cartridge 20 instead.

Next, a laser beam printer 100 according to a second embodiment of the present invention will be described with reference to FIGS. 8 and 9. Note that components similar to that of the laser beam printer 1 of the above-described first embodiment will be assigned with the same numberings, and description thereof will be omitted to avoid duplication in explanation.

Figure 8:
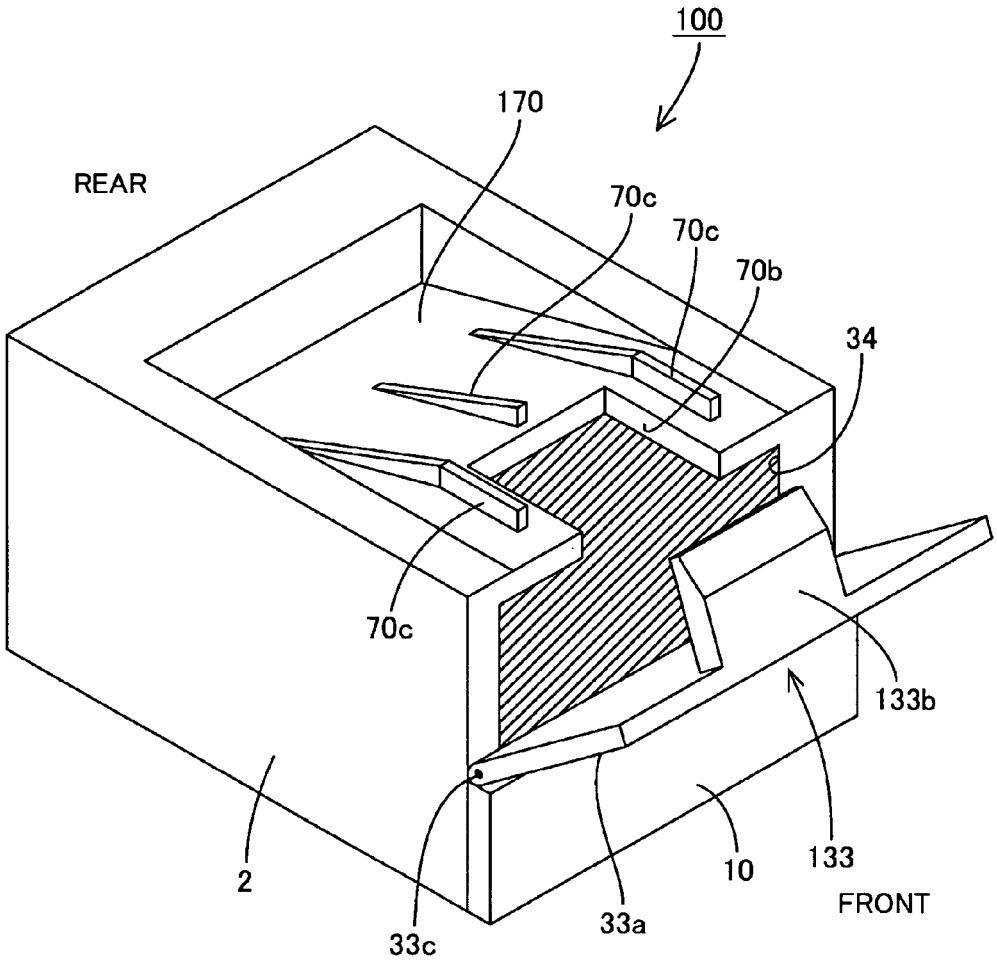
FIG. 8 is a schematic diagram of a laser beam printer according to a second embodiment of the present invention.
Figure 9:
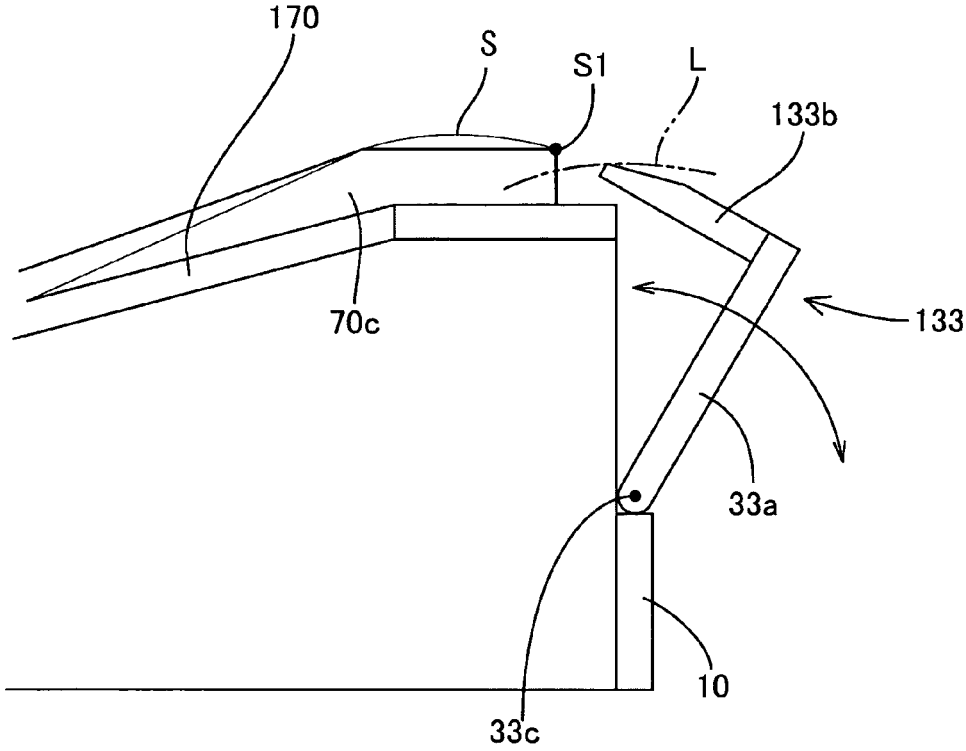
FIG. 9 is an explanatory view showing main parts of the laser beam printer of FIG. 8.

As shown in FIGS. 8 and 9, a discharge tray 170 formed on top of the laser beam printer 100 differs from the discharge tray 70 according to the first embodiment by also having ribs 70*c* formed on the top thereof for supporting recording sheets S. The ribs 70*c* are disposed at least on both sides of the cutout part 70*b* and, as shown in FIG. 9, support recording sheets S at a position higher than the bottom surface of the discharge tray 170. A cover 133 disposed on the front surface of the laser beam printer 100 is also different from the cover 33 according to the first embodiment. The cover 133 includes a top cover part 133*b* having a free end that tapers toward the edge. This construction shortens the distance from the pivotal shaft 33*c* to a path L followed by the outermost edge of the top cover part 133*b* when the cover 133 is opened and closed. That is, as shown in FIG. 9, even when a recording sheet S of a maximum size that can be printed by the laser beam printer 100 is supported on the ribs 70*c*, the path L traced by the top cover part 133*b* of the cover 133 passes below a leading edge S1 of the recording sheet S. Hence the recording sheet S discharged onto the ribs 70*c* does not interfere with the pivoting of the cover 133.

With this construction, the opening and closing path of the top cover part 133*b* does not cross through the space above the discharge tray 170 for accommodating a discharged recording sheet S of the maximum size that can be printed by the laser beam printer 100. Accordingly, a recording sheet S stacked on the discharge tray 170 does not inhibit movement of the cover 133 during operations to open or close the cover 133, thereby facilitating such opening and closing operations.

Figure 10:
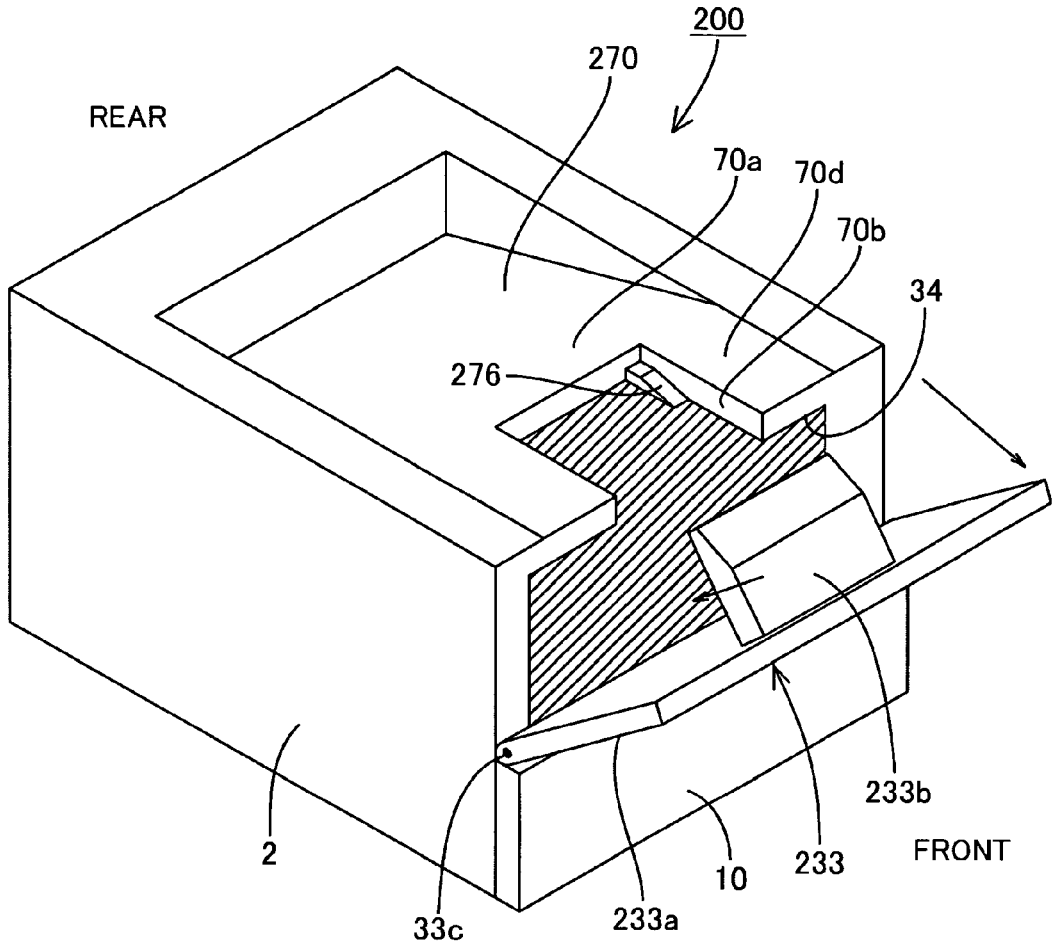
FIG. 10 is a schematic diagram of a laser beam printer according to a third embodiment of the present invention.

Next, a laser beam printer 200 according to a third embodiment of the present invention will be described with reference to FIGS. 10 and 11. Note that components similar to that of the above-described embodiments will the assigned with the same numberings, and description thereof will be omitted to avoid duplication in explanation.

Figure 11:
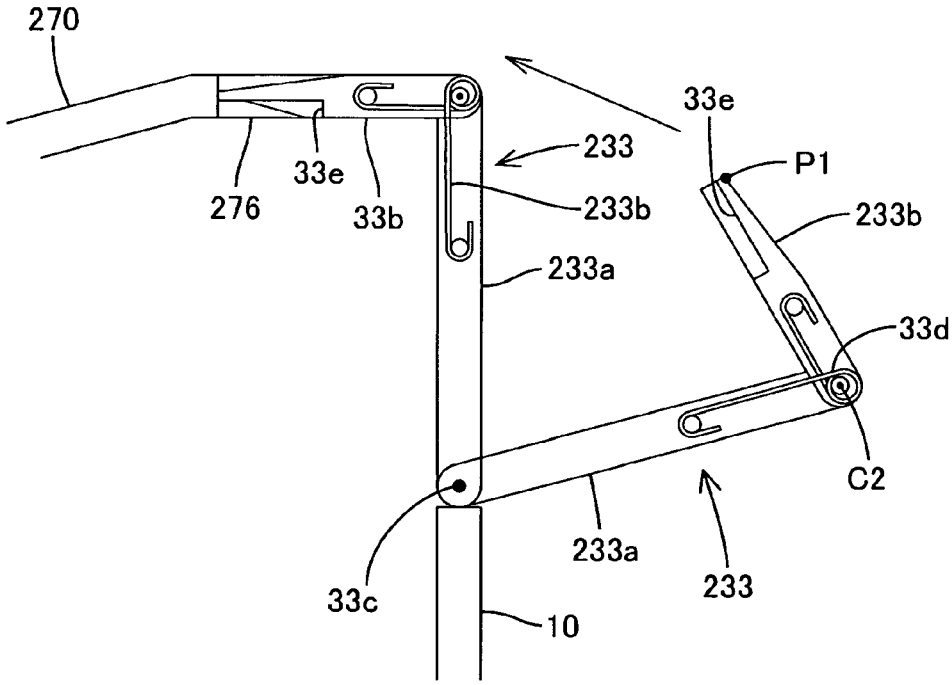
FIG. 11 is an explanatory view showing main parts of the laser beam printer of FIG. 10.

As shown in FIG. 11, the laser beam printer 200 has a cover 233 disposed on the front surface of the main casing 2 that differs from the cover 33 according to the first embodiment. The cover 233 includes a front cover part 233*a* and a top cover part 233*b* configured to pivot about an axis C2 on the front cover part 233*a*. A step part 33*e* is formed in the top cover part 233*b*. An angle formed by the front cover part 233*a* and the top cover part 233*b* is maintained slightly smaller than 90° (such as 80°) by a spring member 33*d*.

The laser beam printer 200 also has a discharge tray 270. As shown in FIG. 10, the discharge tray 270 includes a tapered part 276 formed on the inside of the cutout part 70*b*. When the cover 233 is pivoted from an open position to a closed position, the step part 33*e* formed in the top cover part 233*b* is guided along the tapered part 276 as the cover 233 nears the closed position. As a result, the top cover part 233*b* resists the urging force of the spring member 33*d* and the angle between the front cover part 233*a* and the top cover part 233*b* grows slightly until the cover 233 reaches the closed position shown in FIG. 11.

With this construction, the angle formed between the front cover part 233*a* and the top cover part 233*b* when opening and closing the cover 233 is smaller than the angle formed therebetween when the cover 233 is in the closed position. Accordingly, a distance from the pivotal shaft 33*c* of the cover 233 to an outermost point P1 on the edge of the top cover part 233*b* is reduced during opening and closing operations. As a result, the outermost point P1 of the top cover part 233*b* moves at a position lower than a bottom surface 70*d* of the discharge tray 270 and does not interfere with a recording sheet S maintained on the bottom surface 70*d*. Hence, the recording sheet S discharged onto the discharge tray 270 does not inhibit opening and closing operations of the cover 233.

Next, a laser beam printer 300 according to a fourth embodiment of the present invention will be described with reference to FIG. 12. Description of components similar to that of the above-described embodiments will be omitted to avoid duplication in explanation.

Figure 12:
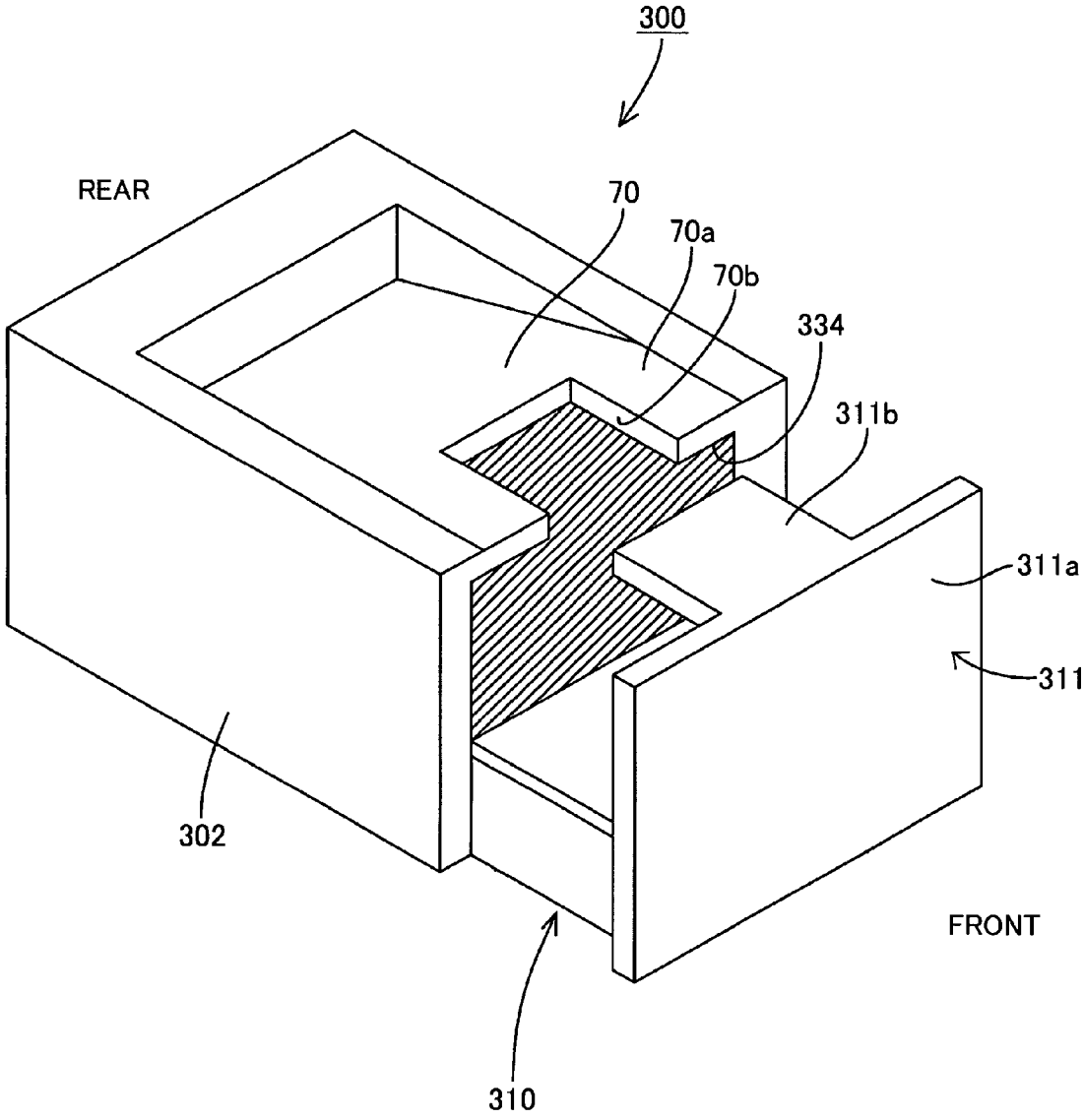
FIG. 12 is a schematic diagram of a laser beam printer according to a fourth embodiment of the present invention.

The laser beam printer 300 shown in FIG. 12 includes a main casing 302 and a sheet supply cassette 310 that is inserted into the front side of the main casing 302. The main casing 302 is formed with an opening 334 continuous with the cutout part 70*b*. The sheet supply cassette 310 includes a front wall 311 that constitutes the entire front surface of the main casing 302 and extends to the top surface of the main casing 302. The front wall 311 includes a front cover part 311*a* and a plate-shaped top cover part 311*b* that are integrally formed and function as a cover for the opening 334 and the cutout part 70*b*. The front wall 311 moves forward and rearward during operations to open and close the sheet supply cassette 310, thereby exposing and covering the opening 334 and the cutout part 70*b*.

The top surface of the top cover part 311*b* may be positioned substantially flush with the top surface of the main discharge tray 70*a*. However, positioning the top surface of the top cover part 311*b* slightly lower than the top surface of the main discharge tray 70*a* will ensure that the recording sheet S and the top cover part 311*b* do not interfere with each other.

Next, a laser beam printer 400 according to a fifth embodiment of the present invention will be described with reference to FIGS. 13 to 14(*c*). Description of components similar to that of the above-described embodiments will be omitted to avoid duplication in explanation.

Figure 13:
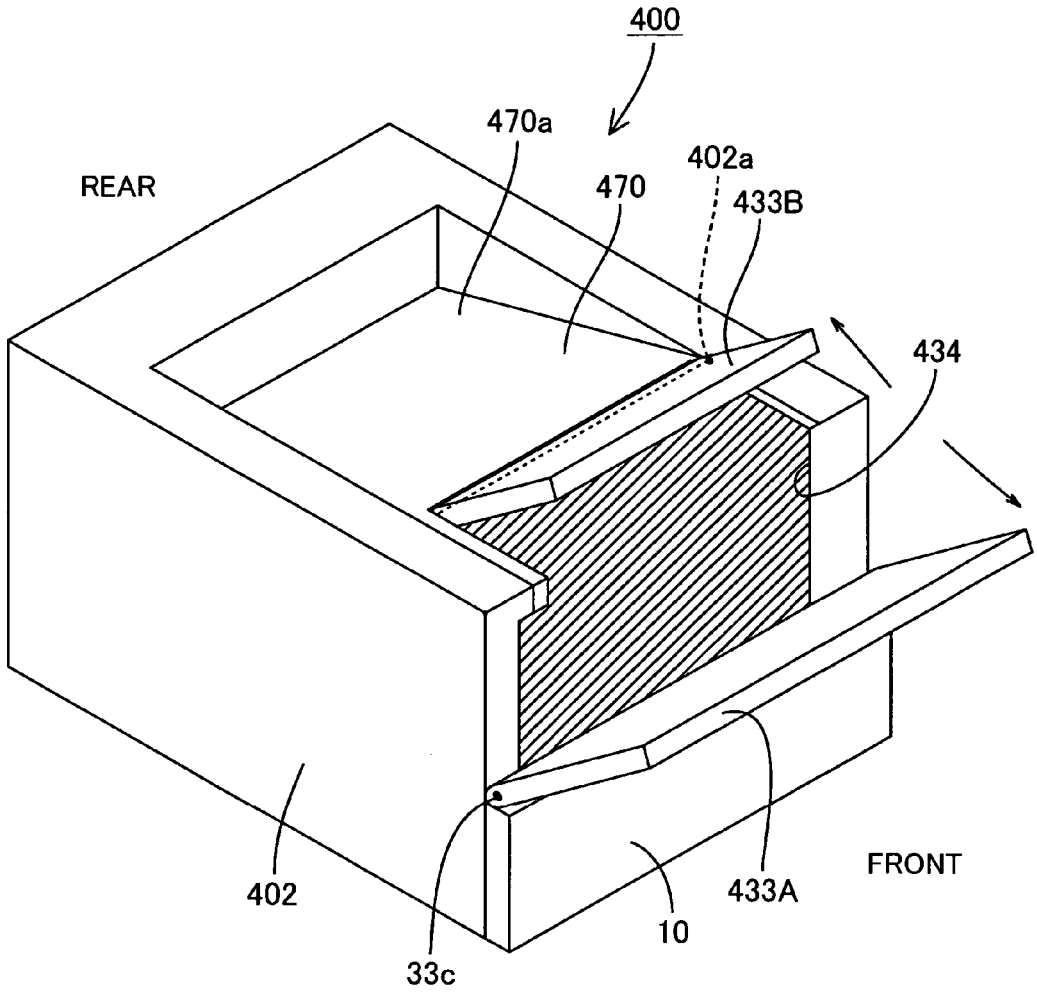
FIG. 13 is a schematic diagram of a laser beam printer according to a fifth embodiment of the present invention.

As shown in FIG. 13, the laser beam printer 400 includes a main casing 402. The internal components in the main casing 402 are identical to those described in the first embodiment.

An opening 434 is formed in the main casing 402 and extends from the front surface to the top surface of the main casing 402. The laser beam printer 400 also includes a front cover 433A for covering or exposing the opening 434 and a top cover 433B for covering at least the top front portion of the opening 434. The front cover 433A and the top cover 433B are configured as separate parts. The front end of the top cover 433B is a free end, while the rear end is pivotably supported on the main casing 402, enabling the top cover 433B to pivot about a pivotal shaft 402*a* extending in the left-to-right direction.

The top cover 433B forms part of a discharge tray 470 provided on top of the main casing 402 for supporting a discharged recording sheet S. As in the first embodiment, the grip 23 (see FIG. 3) provided on the process cartridge 20 is positioned below the opening 434 (area covered by the top cover 433B).

The top end of the front cover 433A is a free end, while the bottom end is pivotably supported on the main casing 402, enabling the front cover 433A to pivot about a shaft 33*c* extending left-to-right.

Figure 14A:
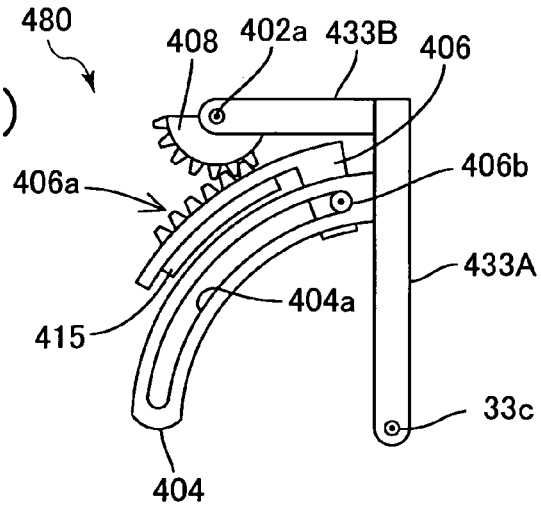
FIGS. 14(*a*) to 14(*c*) are explanatory views showing main parts of the laser beam printer of FIG. 13.
Figure 14B:
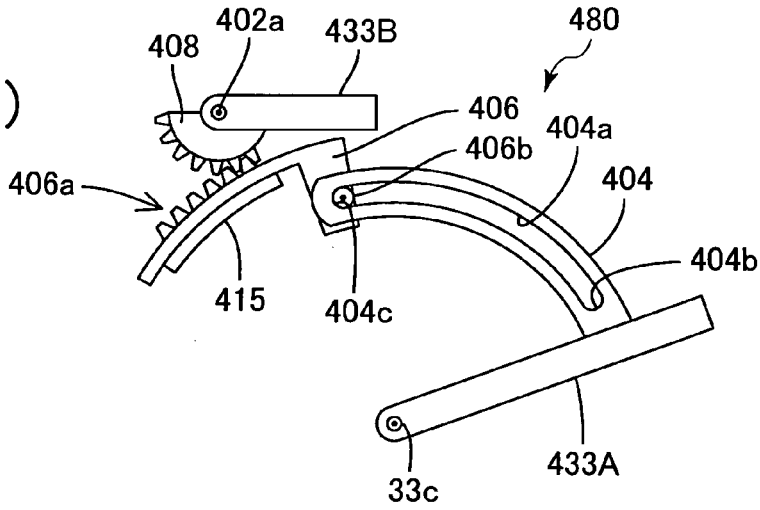
Figure 14C:
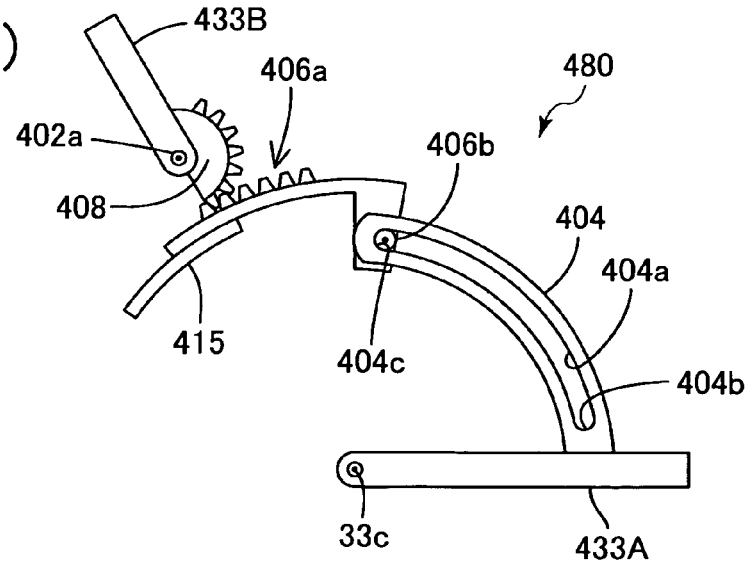

As shown in FIG. 14(*a*), the laser beam printer 400 includes an interlocking mechanism 480 that interlocks opening and closing movement of the front cover 433A and the top cover 433B so that, when one is opened or closed, the interlocking mechanism 480 ensures that the other also opens or closes in association.

The interlocking mechanism 480 includes a rail 404, a coupling member 406, and a gear 408. The rail 404 is fixed to the front cover 433A, and an arc-shaped groove 404*a* is formed in the rail 404. The coupling member 406 includes a gear 406*a*, a protruding part 406*b* that slidably engages with the groove 404*a*, and an inner guide plate 415 fixed to the main casing 402. The gear 408 is rotatably supported on the shaft 402*a* of the top cover 433B and engages with the gear 406*a*.

If an operation to open the front cover 433A is begun when the top cover 433B and the front cover 433A are in the closed state shown in FIG. 14(*a*), then the rail 404 moves in association with the front cover 433A and the protruding part 406*b* moves relative to the groove 404*a* as shown in FIG. 14(*b*). When the protruding part 406*b* reaches an end 404*c* of the groove 404*a*, the coupling member 406 begins moving together with the rail 404, transferring a motive force to the gear 408. As a result, the top cover 433B fixed to the gear 408 pivots as shown in FIG. 14(*c*), opening the top surface of the main casing 402.

The closing operation is performed in reverse. From the state shown in FIG. 14(*c*), the protruding part 406*b* moves relative to the groove 404*a* along with movement of the front cover 433A. When the protruding part 406*b* reaches an end 404*b*, the end 404*b* presses against the protruding part 406*b*, moving the coupling member 406. As a result, the gear 408 is displaced and the top cover 433B returns to the state shown in FIG. 14(*a*).

With this construction, even when the opening 334 is opened as shown in FIG. 13, enabling the user to access components inside the main casing 402 from above, the recording sheet S is reliably maintained on a main discharge tray 470*a* of the discharge tray 470 and the top cover 433B.

By providing the interlocking mechanism 480, operations to open and close one of the front cover 433A and the top cover 433B also open the other in association, thereby eliminating the need for the user to perform an operation to open the other part, improving operability.

Figure 15:
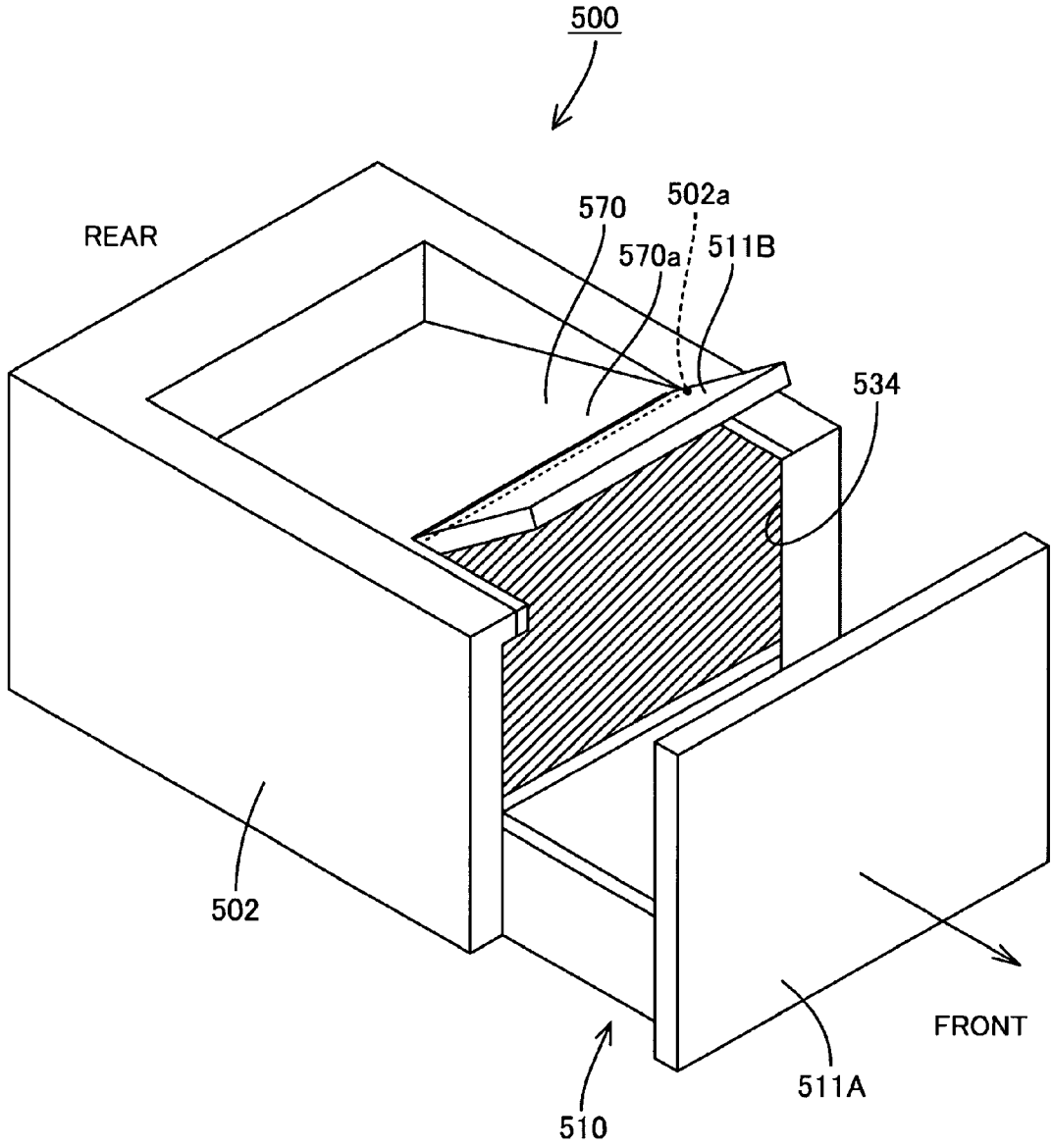
FIG. 15 is a schematic diagram of a laser beam printer according to a sixth embodiment of the present invention.

Next, a laser beam printer 500 according to a sixth embodiment of the present invention will be described with reference to FIGS. 15 and 16. Description of components similar to that of the above-described embodiments will be omitted to avoid duplication in explanation.

The laser beam printer 500 includes a main casing 502 and a sheet supply cassette 510 that is inserted into the front side of the main casing 502. The main casing 502 is formed with an opening 534. The sheet supply cassette 510 includes a front cover 511A that constitutes the entire front surface of the main casing 502 and extends to the top surface of the main casing 502. The front wall 511 moves forward and rearward during operations to open and close the sheet supply cassette 510, thereby exposing and covering the front part of the opening 534.

The laser beam printer 500 also includes a discharge tray 570 formed on the top of the casing 502 for receiving a discharged recording sheet S. The discharge tray 570 includes a main discharge tray 570*a* and a top cover 511B. The top cover 511B is pivotably supported on the top of the casing 502 and can pivot about a pivotal shaft 502*a* to open and close the upper part of the opening 534.

Figure 16A:
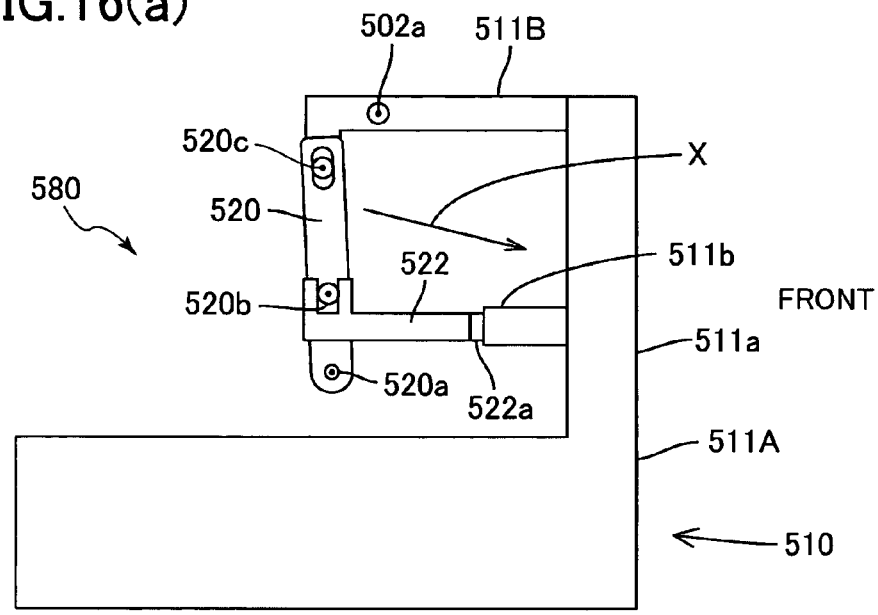
FIG. 16(*a*) is a plan view showing main parts of the laser beam printer of FIG. 15 wherein a front cover is closed.
Figure 16B:
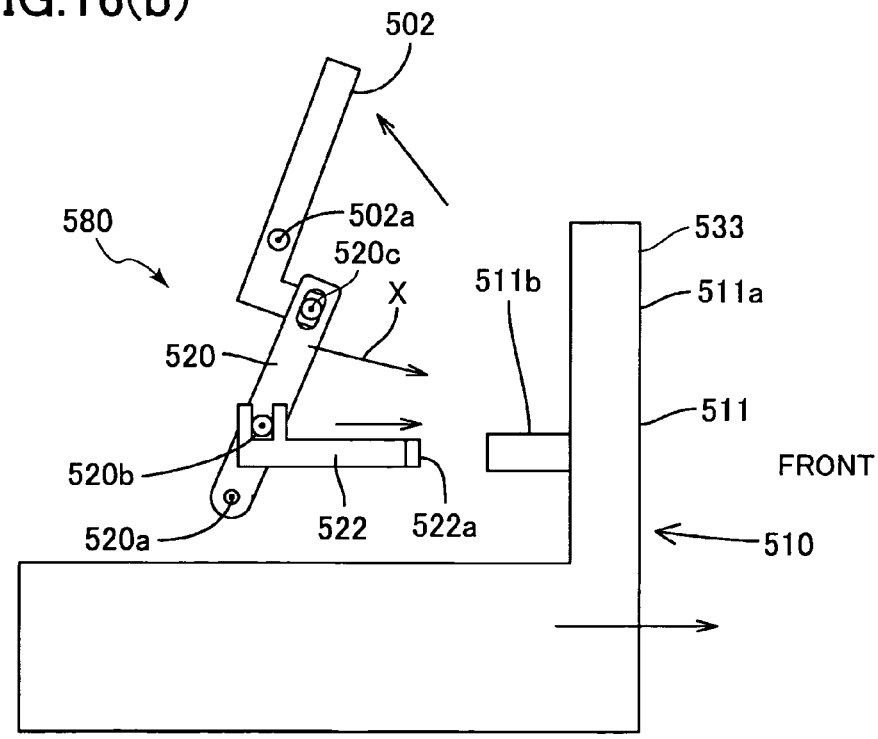

As shown in FIG. 16(*a*), the laser beam printer 500 includes an interlocking mechanism 580 that interlocks opening and closing operations of the front cover 511A and the top cover 511B so that the top cover 511B is made to open and close when the front cover 511A is slid open or closed.

The interlocking mechanism 580 includes a section 520 and a section 522. The section 520 is supported on the top cover 511B so as to pivot about a pivotal shaft 520*c* and is also pivotably supported on the casing 502 so as to pivot about a pivotal shaft 520*a*. The section 520 is also urged by a spring (not shown) in a direction indicated by an arrow X. The section 522 engages with the section 520 and is capable of pivoting about a pivotal shaft 520*b*. An engaging section 522*a* is formed on the other end of the section 522. The engaging section 522*a* engages with an engaging part 511*b* formed on the front cover 511A.

When the front cover 511A and the top cover 511B are in a closed state shown in FIG. 16(*a*), the engaging section 522*a* remains engaged with the engaging part 511*b*. However, when the front cover 511A is pulled outward, the engaging section 522*a* disengages from the engaging part 511*b*, and the section 520 is displaced by the spring in the direction X. As a result, the section 520 moves forward relative to the top cover 511B, causing the top cover 511B to pivot open about the pivotal shaft 502*a* as shown in FIG. 16(*b*).

Conversely, if the front surface 511 is pushed closed from the state in FIG. 16(*b*), the engaging section 522*a* engages with the engaging part 511*b*, causing the top cover 511B to close as shown in FIG. 16(*a*). In the embodiment described above, even when the opening 534 is opened to enable the user to access components inside the casing 502 from above, the recording sheet S is reliably maintained by the main discharge tray 570*a* of the discharge tray 570 and the top cover 511B.

While some exemplary embodiments of this invention have been described in detail, those skilled in the art will recognize that there are many possible modifications and variations which may be made in these exemplary embodiments while yet retaining many of the novel features and advantages of the invention.

For example, in the embodiments described above, the cutout part 70*b* is formed in the widthwise center region of the discharge tray. However, the position of the cutout part 70*b* is not limited to the embodiment described above. For example, it is possible to provide the main discharge tray in the widthwise center region of the top surface and form a cutout part near a widthwise side of the discharge tray. In this case, the grip 23 of the process cartridge 20 should also be positioned below the cutout part on the widthwise side. Further, in the embodiments described above, the process cartridge 20 is used as an example of a detachable component, but the present invention may be applied to other detachable components.

What is claimed is:

1. An image-forming device comprising:

a casing having a vertical wall and a top wall, the vertical wall being formed with an opening through which a detachable member is inserted into and removed from the casing, the top wall being formed with a cutout part that is continuous with the opening; and a cover including a first part that covers the opening and a second part that covers the cutout part, the cover being movable between an open state and a closed state, wherein:

when the cover is in the closed state, the second part of the cover and a portion of the top wall of the casing are adjacent to one another in a first direction; and when the cover is in the open state, the second part of the cover and the portion of the top wall are separated from each other and a recording medium discharged from the casing is supported by a part of the top wall such that the recording medium bridges over the cutout part.

2. The image-forming device according to claim 1, wherein the detachable member is located inside the casing at a location where a grip of the detachable member locates below the cutout portion.

3. The image-forming device according to claim 1, wherein the cutout portion has a width of 10 to 20 cm in the first direction.

4. The image-forming device according to claim 1, wherein a path followed by the second part of the cover when opening and closing the cover is out of overlap with a space occupied by the recording medium that is supported on the top wall and that is of a maximum size that can be used in the image-forming device.

5. The image-forming device according to claim 4, wherein the second part of the cover is pivotably supported on the first part of the cover such that an angle between the first part and the second part can change, and an angle between the first part and the second part when opening and closing the cover is smaller than an angle formed between the first part and the second part when the cover is in the closed state.

6. The image-forming device according to claim 1, further includes a process cartridge as the detachable member, wherein:

the process cartridge includes at least one of an electrode and a drive unit;

the cutout part is disposed in a center region of the top wall in the first direction; and the part of the top wall on the side of the cutout part with respect to the first direction covers the at least one of the electrode and the drive unit.

7. The image-forming device according to claim 1, wherein the first part of the cover has a first end and a second end opposite to the first end, and the second part of the cover is connected to the first end of the first part, and the cover is pivotably supported on the casing at the second end of the first part.

8. The image-forming device according to claim 1, wherein the cover is slidable with respect to the casing in a second direction orthogonal to the first direction.

9. The image-forming device according to claim 1, further comprising a supply cassette that supports the recording medium and is slidingly inserted into the casing, the supply cassette having the cover.

10. The image-forming device according to claim 1, further comprising:

a supply cassette that supports the recording medium;

an image forming unit that forms an image on the recording medium supplied from the supply cassette; and a discharge unit that discharges the recording medium formed with the image in the image forming unit onto the top wall of the casing, the top wall functioning as a discharge tray.

11. The image-forming device according to claim 1, wherein the first part of the cover is pivotably supported on the casing about a horizontal axis and has a top free end and a bottom end opposite to the top free end.

12. The image-forming device according to claim 1, wherein the casing has a first side and a second side opposite to the first side with respect to a second direction orthogonal to the first direction, and the casing has the vertical wall at the first side, and the cover is slidable with respect to the casing in the second direction.

13. The image-forming device according to claim 1, wherein:

the recording medium is discharged from the casing in a predetermined direction that is orthogonal to the first direction; and when the cover is in the open state, the recording medium is supported by the part of the top wall such that the recording medium bridges over the cutout part in the first direction.

14. An image-forming device comprising:

a casing having a vertical wall and a top wall, the vertical wall being formed with a first opening, the top wall being formed with a second opening continuous with the first opening;

a first cover capable of opening and closing to selectively expose and cover the first opening; and a second cover supported on the casing, the second cover pivoting open and closed about an axis to selectively expose and cover the second opening, wherein when the first cover and the second cover are open, a recording medium discharged from the casing is supported on the top wall and the second cover.

15. The image-forming device according to claim 14, wherein a detachable member is inserted to or removed from the casing through the first opening and the second opening.

16. The image-forming device according to claim 15, wherein the detachable member has a grip that is located below the second opening when the detachable member is inserted into the casing.

17. The image-forming device according to claim 14, further comprising an interlocking mechanism that interlocks opening movement of the first cover and the second cover.

18. The image-forming device according to claim 14, further comprising an interlocking mechanism that interlocks closing movement of the first cover and the second cover.

19. The image-forming device according to claim 14, wherein the first cover is pivotably supported on the casing about a horizontal axis and has a top free end and a bottom end opposite to the top free end.

20. The image-forming device according to claim 14, wherein the casing has a first side and a second side opposite to the first side with respect to a predetermined direction, and the casing has the vertical wall at the first side, and the first cover is slidable with respect to the casing in the predetermined direction.

21. The image-forming device according to claim 14, wherein the recording medium is supported on the top wall and the second cover when the first cover and the second cover are fully open.

* * * * *